US008800278B2

(12) United States Patent
Nakamura

(10) Patent No.: US 8,800,278 B2
(45) Date of Patent: Aug. 12, 2014

(54) HYDRAULIC DRIVE DEVICE FOR HYDRAULIC EXCAVATOR

(75) Inventor: Kazunori Nakamura, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 1046 days.

(21) Appl. No.: 12/519,668

(22) PCT Filed: Dec. 17, 2007

(86) PCT No.: PCT/JP2007/074233

§ 371 (c)(1),
(2), (4) Date: Jun. 17, 2009

(87) PCT Pub. No.: WO2008/075648

PCT Pub. Date: Jun. 26, 2008

(65) Prior Publication Data

US 2010/0031649 A1 Feb. 11, 2010

(30) Foreign Application Priority Data

Dec. 18, 2006 (JP) ..... 2006-339981

(51) Int. Cl.
*F15B 21/14* (2006.01)

(52) U.S. Cl.
USPC ..... 60/424

(58) Field of Classification Search
USPC ..... 60/424, 468; 91/517, 518
See application file for complete search history.

(56) References Cited

U.S. PATENT DOCUMENTS 6,502,393 B1 * 1/2003 Stephenson et al. ..... 60/424
2007/0028607 A1 2/2007 Ishikawa et al.

FOREIGN PATENT DOCUMENTS

JP 3-5769 U 1/1991
JP 10-331209 A 12/1998
JP 2004-346485 A 12/2004

* cited by examiner

*Primary Examiner* — F. Daniel Lopez
(74) *Attorney, Agent, or Firm* — Crowell & Moring LLP

(57) ABSTRACT

[Problem] To provide a hydraulic drive system for a hydraulic excavator, which makes it possible to efficiently perform grading work by using residual energy of pressure oil in a hydraulic circuit although no attention has been paid to the residual energy in conventional technologies.

[Solution] A hydraulic drive system for a hydraulic excavator is provided with a boom cylinder 1 and arm cylinder 2, a main hydraulic pump 4 for feeding pressure oil to both the cylinders 1,2, a directional control valve 7 for a boom and directional control valve 8 for an arm to control flows of pressure oil to be fed to the boom cylinder 1 and arm cylinder 2, respectively, and a reservoir line 8*c* connecting the directional control valve 8 for the arm with a working oil reservoir 6. A flow-rate control valve 15 capable of selectively closing the reservoir line 8*c* is arranged and, when a rod-side hydraulic pressure of the arm cylinder 2 has increased to a preset value or greater while grading work is performed by a combined operation of boom raising and arm crowding, the reservoir line 8*c* is closed by the flow-rate control valve 15 to prevent drainage of rod-side pressure oil from the arm cylinder 2 to the working oil reservoir 8*c* and to feed the rod-side pressure oil to a bottom side of the boom cylinder 1.

1 Claim, 2 Drawing Sheets

HYDRAULIC DRIVE DEVICE FOR HYDRAULIC EXCAVATOR

TECHNICAL FIELD

This invention relates to a hydraulic drive system for a hydraulic excavator, which is provided with a boom cylinder and arm cylinder, a main hydraulic pump for generating a hydraulic pressure for driving these cylinders, and a directional control valve for the boom cylinder and a directional control valve for the arm cylinder to control flows of pressure oil to be fed from the main hydraulic pump to the boom cylinder and arm cylinder and which makes it possible to perform grading work.

BACKGROUND ART

A hydraulic excavator is provided with an undercarriage capable of traveling by crawlers or the like and a revolving upperstructure swingably mounted on the undercarriage. These undercarriage and revolving upperstructure make up a body. Also provided are attachments such as a boom, arm and bucket for performing digging work or the like and various hydraulic cylinders called a boom cylinder, arm cylinder and bucket cylinder for driving these attachments, respectively. These attachments and hydraulic cylinders make up a front working implement. The front working implement constructed as described above is arranged on the revolving upperstructure to perform various work such as earth/sand digging work.

To drive and control various hydraulic actuators such as the above-described various hydraulic cylinders, this hydraulic excavator is provided with a hydraulic drive system, which is equipped with a main hydraulic pump as a generation source of a hydraulic pressure for feeding pressure oil to the various hydraulic actuators, directional control valves for controlling flows of pressure oil to be fed from the main hydraulic pump to the respective hydraulic actuators, and a working oil reservoir for storing pressure oil to be released from the respective hydraulic actuators via their corresponding directional control valves. When driving a hydraulic cylinder in such a hydraulic drive system, pressure oil is fed from a hydraulic pump to one of a bottom side and rod side of the hydraulic cylinder via a directional control valve and is released from the other side to perform the drive. When plural hydraulic cylinders in a front working implement are operated in combination, pressure oils released from the other sides of the hydraulic cylinders, that is, from their pressure-oil release sides are drained directly to a working oil reservoir without utilizing them.

When a combined operation of boom raising and arm crowding (a combined operation that downwardly pivots the arm while upwardly tilting the boom) is performed by feeding pressure oil to bottom sides of a boom cylinder and arm cylinder and extending them in a hydraulic excavator in a hydraulic excavator, for example, the hydraulic pressure on the pressure-oil feed side, that is, the bottom side of the boom cylinder becomes high, and as a result, the hydraulic pressure on the pressure-oil release side, that is, the rod side of the boom cylinder also rises. However, the hydraulic pressure on the rod side at which such energy still remains has been drained to a working oil reservoir without effectively utilizing it. Paying attention to this problem, the assignee already developed the technology described in Patent Document 1 to effectively utilize the pressure oil on the pressure-oil release side of a hydraulic cylinder, said pressure oil having been effectively unutilized until that time, upon combined operation of hydraulic cylinders.

With a view to facilitating the understanding of the characteristic features of the present invention to be described subsequently herein while positioning as a conventional technology the technology described in Patent Document 1, the details of the conventional technology will be outlined hereinafter. Specifically, a description will be made centering around the technical details of features relevant to the present invention while using the terms employed in Patent Document 1 with reference numerals added in parentheses.

The hydraulic drive system for a hydraulic excavator, said system pertaining to the conventional technology described in Patent Document 1, is provided, according to the description of the embodiments of the invention, with a boom cylinder (6) and arm cylinder (7) arranged for a combined operation as hydraulic actuators of a front working implement and also with a main hydraulic pump (21) commonly employed as a generation source for a hydraulic pressure to be fed to the boom cylinder (6) and arm cylinder (7). To permit driving the boom cylinder (6) and arm cylinder (7) with pressure oil from the common main hydraulic pump (21), parallel lines (27,28) are also provided to feed the pressure oil to both the hydraulic actuators. Also provided are a directional control valve (23) for a boom to control a flow of pressure oil to be fed from the main hydraulic pump (21) to the boom cylinder (6), a directional control valve (24) for an arm to control a flow of pressure oil to be fed from the main hydraulic pump (21) to the arm cylinder (7), and a reservoir line (42) connecting the directional control valve (23) for the boom and the directional control valve (24) for the arm with a working oil reservoir (reservoir (43)).

According to the conventional technology described in Patent Document 1, the above-described hydraulic drive system is provided with a communication line (40) communicating the reservoir line (42) and an upstream side of the directional control valve (24) for the arm with each other and a flow combiner valve (44) arranged in the reservoir line 42 as a closure means for permitting selective closure of the reservoir line (42). This flow combiner valve (44) is a normally-open, hydraulic pilot-operated selector valve which, when the pressure on a bottom side of the arm cylinder (7) has arisen to a high pressure of at least a predetermined pressure value, is switched from an open position to a closed position by the pressure. When this flow combiner valve (44) is in the open position, it serves to return a hydraulic pressure, which is released from the boom cylinder (6), to the working oil reservoir via the directional control valve (23) for the arm. When the pressure on the bottom side of the arm cylinder (7) has arisen to a high pressure of at least the predetermined pressure and the flow combiner valve (44) has been switched to the closed position, on the other hand, it serves to prevent a hydraulic pressure, which is especially on a rod side of the boom cylinder (6), from being returned to the working oil reservoir.

The hydraulic drive system according to the conventional technology is provided with the above-described means so that, when the pressure on the bottom side of the arm cylinder (7) has arisen to a high pressure of at least the predetermined pressure value while earth/sand digging work is performed by extending the boom cylinder (6) and arm cylinder (7) and performing a combined operation of boom raising and arm crowding, the reservoir line (42) is closed by the flow combiner valve (44) and the pressure oil on a rod side of the boom cylinder (6), said pressure oil being released to the reservoir line (42), is guided to the communication line (40) and is fed to the upstream side of the directional control valve (24) for the arm. The pressure oil on the rod side of the boom cylinder (6) is combined to pressure oil, which is to be fed to the arm cylinder (7) from the main hydraulic pump (21), on the upstream side of the directional control valve (24) for the arm, and via the same directional control valve (24), the thus-combined pressure oil is fed to the bottom side of the arm cylinder (7). According to this hydraulic drive system, the arm cylinder (7) can, therefore, be extended faster than before by effectively utilizing the hydraulic pressure on the rod side of the boom cylinder (6), said hydraulic pressure still having residual energy, when a combined operation is performed by the boom cylinder (6) and arm cylinder (7). Patent Document 1: JP-A-2004-346485 (Pages 5-12, FIGS. 1-2)

DISCLOSURE OF THE INVENTION

The hydraulic drive system according to the conventional technology described in Patent Document 1 is desirous as a technology for energy saving because, when earth/sand digging work is performed by a combined operation of boom raising and arm crowding, the hydraulic drive system is designed to improve the utilization efficiency of the energy of a hydraulic pressure by utilizing the hydraulic pressure on the rod side of the boom cylinder, said hydraulic pressure still having residual energy, for the acceleration of the arm cylinder. Concerning this conventional hydraulic drive system, however, there is still unutilized residual energy the utilization method of which has not been considered yet in the case that work is performed by such a combined operation of boom raising and arm crowding. Accordingly, the energy of pressure oil remaining in the hydraulic circuit is not considered to be fully utilized. A description will hereinafter be made in this respect.

Taking a look at the residual energy of pressure oil, said residual energy being utilizable upon combined operation of boom raising and arm crowding, this residual energy of pressure oil is the pressure of pressure oil released from the respective rod sides of a boom cylinder and arm cylinder. To permit the utilization of the residual energy of such pressure oil, it is, however, necessary to prevent the drainage of the pressure oil to the working oil reservoir. Concerning the hydraulic pressure on the rod side of the boom cylinder out of the residual energies of these pressure oils, the conventional technology utilizes the residual energy by preventing the hydraulic pressure from draining to the working oil reservoir. With respect to the pressure oil on the rod side of the arm cylinder, however, the conventional technology pays no attention at all to the utilization of its residual energy due to the nature of the work under consideration.

Now discussing about this matter, the work by a combined operation of boom raising and arm crowding as considered in the conventional technology is practically such work as earth/sand digging work and, as far as reading Patent Document 1, no work is specifically considered other than the above-described type of work. Upon performing arm crowding in such earth/sand digging work, it is necessary to cause the arm to downwardly pivot under strong force by an extension of the arm cylinder such that the bucket can be driven into the earth to fill the bucket up with the dug earth/sand.

To prevent the pressure oil on the rod side of the arm cylinder from interfering with such a pivoting motion of the arm, it is hence necessary to permit the release of pressure oil as fast as possible from the rod side of the arm cylinder to the working oil reservoir upon extension of the arm cylinder. From the nature of earth/sand digging work, however, it is impossible to utilize the residual energy of the hydraulic pressure on the rod side of the arm cylinder by preventing the pressure oil on the rod side from draining to the working oil reservoir. As a corollary to this, attention itself can hardly be directed to the utilization of such residual energy of a hydraulic pressure on the rod side of the arm cylinder.

In the meantime, the present inventor studied a variety of energy-saving methods with respect to hydraulic drive systems for hydraulic excavators. In the course of the study, it was found that, even in the case of work by a combined operation of boom raising and arm crowding, there is still a room for permitting effective utilization of the residual energy of pressure oil released from the rod side of the arm cylinder if the work is grading work. This grading work means work that subsequent to digging, horizontally levels the ground by horizontally moving a leading edge portion of the bucket from a point ahead of the hydraulic excavator toward the operator. To accomplish the grading work that horizontally moves the leading edge portion of the bucket as described above, it is necessary to hold the leading edge portion of the bucket at the same height by a combined operation of boom raising and arm crowding while preventing, with the arm cylinder, the arm from falling (downwardly pivoting) by its own weight while the arm is crowded to horizontally move the bucket toward the operator.

To realize such a motion of the arm, the flow passage on the release side of the directional control valve for the arm cylinder is restricted to develop a pressure on the rod side of the arm cylinder such that the pressure oil on the rod side of the arm cylinder is not drained freely to the working oil reservoir. Different from earth/sand digging work, it was thus considered possible from the nature of grading work to utilize the residual energy of the hydraulic pressure on the rod side of the arm cylinder in the grading work by preventing the pressure oil from draining to the working oil reservoir. As the pressure-receiving area of a piston in the arm cylinder is smaller on the rod side than on the bottom side, the hydraulic pressure on the rod side of the arm cylinder is higher, by the pressure itself, than the hydraulic pressure on the bottom side. It was, therefore, contemplated that the hydraulic pressure on the rod side of the arm cylinder would be able to stand utilization as effective unutilized energy. From the foregoing, the present inventor paid attention to the utilization of the residual energy of the pressure oil on the rod side of the arm cylinder for the improvement of work efficiency upon performing grading work although no attention was paid to the residual energy in the conventional technology.

With the above-described technical background in view, it is the technical object of the present invention to provide a hydraulic drive system for a hydraulic excavator, which can efficiently perform grading work by utilizing the residual energy of hydraulic pressure in a hydraulic circuit although no attention was paid to such residual energy in the conventional technology.

Means for Solving the Problem

To achieve the above-described technical object, the present invention is constructed such that in a hydraulic drive system for a hydraulic excavator, said system being provided with a boom cylinder and arm cylinder for driving a boom and arm of a front working implement, respectively, a main hydraulic pump as a generation source of a hydraulic pressure to be fed to the boom cylinder and arm cylinder, a directional control valve for the boom cylinder to control a flow of pressure oil to be fed from the main hydraulic pump to the boom cylinder, a directional control valve for the arm cylinder to control a flow of pressure oil to be fed from the main hydraulic pump to the arm cylinder, and a reservoir line connecting the directional control valve for the arm cylinder with a working oil reservoir, a closure means capable of selectively closing the reservoir line is arranged and, when the pressure of rod-side pressure oil in the arm cylinder has increased to a high pressure of at least a predetermined pressure value while grading work is performed by a combined operation of the boom cylinder and arm cylinder with pressure oil fed to respective bottom sides of the boom cylinder and arm cylinder, the reservoir line is closed by the closure means to prevent drainage of rod-side pressure oil from the arm cylinder to the working oil reservoir and to feed the rod-side pressure oil from the arm cylinder to a bottom side of the boom cylinder via the directional control valve for the boom cylinder.

As the hydraulic drive system of the present invention for the hydraulic excavator "is constructed such that the closure means capable of selectively closing the reservoir line is arranged and, when the pressure of rod-side pressure oil in the arm cylinder has increased to a high pressure of at least the predetermined pressure value while grading work is performed, the reservoir line is closed by the closure means to prevent the drainage of rod-side pressure oil from the arm cylinder to the working oil reservoir and to feed the rod-side pressure oil from the arm cylinder to the bottom side of the boom cylinder via the directional control valve for the boom cylinder", the speed of boom raising can be made faster than before upon performing grading work as will be mentioned hereinafter.

Described specifically, when the performance of grading work is successfully detected based on a rise in the pressure of the pressure oil on the rod side of the arm cylinder to a high pressure of at least the predetermined pressure value as a result of the performance of the grading work by the pressure oil fed to the respective bottom sides of the boom cylinder and arm cylinder, the reservoir line is closed by the closure means, and as a consequence, the pressure of the pressure oil on the rod side of the arm cylinder is further increased to such a level that the pressure of the pressure oil on the bottom side of the boom cylinder can be increased. When the pressure oil of this high pressure on the rod side of the arm cylinder is fed to the bottom side of the boom cylinder via the directional control valve for the boom cylinder without its drainage to the working oil reservoir, the pressure oil of this high pressure is combined to the pressure oil to be fed from the main hydraulic pump to the bottom side of the boom cylinder so that the boom cylinder can be extended faster than before. As has been described above, the hydraulic drive system of the present invention for the hydraulic excavator makes it possible to efficiently perform grading work by utilizing the pressure of the pressure oil on the rod side of the arm cylinder, said pressure being the residual energy of the pressure oil in the hydraulic circuit, although no attention was paid to such residual energy in the conventional technology.

Advantageous Effects Of The Invention

As will become apparent from the description to be made hereinafter, the hydraulic drive system of the present invention for the hydraulic excavator is constructed as described above in the section entitled "leans for Solving the Problem", and therefore, makes it possible to efficiently perform grading work by utilizing the residual energy of the pressure oil in the hydraulic circuit although no attention was paid to such residual energy in the conventional technology and also to contribute to improvements in the energy saving of hydraulic drive systems.

BEST MODES FOR CARRYING OUT THE INVENTION

Desired modes for carrying out the present invention will hereinafter be manifested by describing with reference to FIG. 1 and FIG. 2 how the present invention can be actually embodied.

FIG. 1 is a circuit diagram of a hydraulic drive system for a hydraulic excavator, said hydraulic drive system having been constructed by embodying the present invention, and FIG. 2 is a side view of the hydraulic excavator provided with the hydraulic drive system of FIG. 1. In FIG. 2, the hydraulic drive system is illustrated by simplifying individual elements such as directional control valves 7,8. The hydraulic circuit diagram of FIG. 1 should, therefore, be referred to for the details of the hydraulic drive system.

Based on FIG. 2, an outline will firstly be given about the self-propelled hydraulic excavator on which the hydraulic drive system of FIG. 1 is arranged.

Roughly dividing, this self-propelled hydraulic excavator is constructed of a front working implement 30 for performing various work—such as digging work of earth or sand, loading work of dug earth or sand and grading work to be described subsequently herein—and a traveling body 20 on which the front working implement 30 is arranged. Of these, the body 20 is constructed of an undercarriage 21 adapted as a base for mounting a revolving upperstructure 22 and capable of traveling at a work site, a revolving frame 22*a* swingably mounted on the undercarriage 21, and the revolving upper structure 22 constructed of various equipment arranged on the revolving frame 22*a*. Arranged on the revolving frame 22*a* are, in addition to the front working implement 30, various equipment such as a housing 22*b*, which accommodate therein a main hydraulic pump 4 to be described subsequently herein, an engine 5 for driving the main hydraulic pump and various control devices and the like, and an operator's cab 22*c*. The undercarriage 21 travels by means of crawlers 21*a* in the form of endless chains, to which rotations of sprocket wheels are transmitted.

On the other hand, the front working implement 30 arranged on the body 20 is equipped with a boom 31 arranged at a rear end portion thereof pivotally (tiltably) in a vertical direction on a front part of the revolving frame 22*a*, an arm 32 attached at a rear end portion thereof pivotally (pivotally) in the vertical direction to a front end portion of the boom 31, and a bucket 33 attached pivotally in the vertical direction and detachably to a front end portion of the arm 32. As hydraulic actuators for driving these attachments, respectively, there are also arranged the below-described boom cylinder 1 and arm cylinder 2 shown in FIG. 1 to be described subsequently herein and a bucket cylinder 3 the illustration of which in FIG. 1 is omitted. These boom cylinder 1, arm cylinder 2 and bucket cylinder 3 are driven to extend or retract such that the boom 31, arm 32 and bucket 33 are driven to pivot in the vertical direction.

Based on FIG. 1 and FIG. 2, a description will be made about the hydraulic drive system for the hydraulic excavator, said hydraulic drive system having been constructed by embodying the present invention.

In FIG. 1 and FIG. 2, there are shown a boom cylinder 1 extendable or retractable by a hydraulic pressure to pivotally drive the boom 31, a bottom chamber 1*a* of the boom cylinder 1, a rod chamber 1*b* of the boom cylinder 1, an arm cylinder 2 extendable or retractable by a hydraulic pressure to pivotally drive the arm 32, a bottom chamber 2*a* of the arm cylinder 2, a rod chamber of the arm cylinder 2, a variable displacement, main hydraulic pump 4 as a generation source of a hydraulic pressure to be fed to the boom cylinder 1 and arm cylinder 2, a first pressure-oil feed line 4*a* for feeding pressure oil from the main hydraulic pump 4, a second pressure-oil feed line 4*b* for feeding pressure oil from the main hydraulic pump 4, an engine 5 as a drive source of the hydraulic excavator to drive the main hydraulic pump 4, and a working oil reservoir 6 for storing working oil. The bottom chamber 1*a* of the boom cylinder 1 is a chamber on a side of a bottom of a cylinder tube, and pressure oil is fed to or released from the bottom chamber 1*a* of the boom cylinder 1. The rod chamber 1*b* of the boom cylinder 1 is a chamber on a side of a piston rod of a cylinder tube, and pressure oil is fed to or released from the rod chamber 1*b* of the boom cylinder 1.

In the embodiment depicted in the figures, the single variable displacement, main hydraulic pump 4 is commonly used as generation sources of hydraulic pressures to be fed to the boom cylinder 1 and arm cylinder 2. In the hydraulic excavator, plural hydraulic actuators among the boom cylinder 1 and arm cylinder 2 are concurrently driven, that is, a so-called combined operation is performed with the plural hydraulic actuators. To permit performing such a combined operation by the common main hydraulic pump 4, piping is arranged such that pressure oil is fed from the main hydraulic pump 4 to the boom cylinder 1 and arm cylinder 2 via flow passages which are parallel to each other. Described specifically, oil passages are arranged such that the pressure oil is fed from the main hydraulic pump 4 to the arm cylinder 2 via the second pressure-oil feed line 4*b* and to the boom cylinder 1 via the first pressure-oil feed line 4*a* arranged in parallel with the pressure-oil feed line 4*b* and an equal pressure can hence be fed to both the pressure-oil feed lines 4*a*,4*b*.

There are also shown a directional control valve for the boom to control an operation of the boom cylinder 1 by switching the flow and flow rate of pressure oil to be fed from the main hydraulic pump 4 to the cylinder 1, a bottom-side line 7*a* for the directional control valve 7 for the boom to connect the directional control valve 7 for the boom to the bottom chamber 1*a* of the boom cylinder 1, a rod-side line 7*b* for the directional control valve 7 for the boom to connect the directional control valve 7 to the rod chamber 1*b* of the boom cylinder 1, a reservoir line 7*c* for the directional control valve 7 for the boom to connect the directional control valve 7 for the boom to the working oil reservoir 6, a directional control valve 8 for the arm to control an operation of the arm cylinder 2 by switching the flow and flow rate of pressure oil to be fed from the main hydraulic pump 4 to the cylinder 2, a bottom-side line 8*a* for the directional control valve 8 for the arm to connect the directional control valve 8 for the arm to the bottom chamber 2*a* of the arm cylinder 2, a rod-side line 8*b* for the directional control valve 8 for the arm to connect the directional control valve 8 for the arm to the rod chamber 2*b* of the arm cylinder 2, a reservoir line 8*c* for the directional control valve 8 for the arm to connect the directional control valve 8 for the arm to the working oil reservoir 6, and a restrictor 8*d* additionally arranged in a release-side flow passage within the directional control valve 8 for the arm to permit performing grading work.

Actually, the hydraulic drive system for the hydraulic excavator is also provided with a bucket cylinder 3 and a directional control valve for the bucket to control an operation of the bucket cylinder 3. Their illustration in the hydraulic circuits in FIG. 1 and FIG. 2 is, however, omitted because they have no direct relevance to the essential features of the present invention. When unillustrated control means such as control levers for operating the directional control valves 7,8 are manipulated, a hydraulic pilot pressure from an unillustrated pilot pump is adjusted to pressure values corresponding to the manipulation strokes of the respective control means, and the hydraulic pilot pressures of the pressure values are outputted to signal-receiving ports of the respective directional control valves 7,8. As a result, the amounts of openings of the directional control valves 7,8 are adjusted corresponding to the pressure values of the hydraulic pilot pressures, respectively, to control the driving speeds of the boom cylinder 1 and arm cylinder 2. Depending upon the manipulation directions of the respective control means, the directional control valves 7,8 are switched from the neutral positions to the left positions or right positions to control the driving directions of the boom cylinder 1 and arm cylinder 2.

A more specific description will now be made about the functions of the respective directional control valves 7,8. When a hydraulic pilot pressure which has been adjusted in pressure is outputted to the left signal-receiving port of the directional control valve 7 for the boom, the directional control valve 7 for the boom is switched from the neutral position to the left position (the position illustrated in FIG. 1). The directional control valve 7 for the boom then feeds pressure oil from the main hydraulic pump 4 to the bottom chamber 1*a* of the boom cylinder 1 via the bottom-side line 7*a*, and also releases pressure oil from its rod chamber 1*b* to the working oil reservoir 6 via the rod-side line 7*b* and reservoir line 7*c*. As a consequence, the boom cylinder 1 is caused to extend to perform a boom-raising operation.

Similarly, the directional control valve 7 for the boom is switched to the right position when a hydraulic pilot pressure is outputted to the right signal-receiving port via an unillustrated pilot line. The directional control valve 7 for the boom then feeds pressure oil from the main hydraulic pump 4 to the rod chamber 1*b* of the boom cylinder 1 via the rod-side line 7*b*, and also releases pressure oil from its bottom chamber 1*a* to the working oil reservoir 6 via the bottom-side line 7*a* and reservoir line 7*c*. As a consequence, the boom cylinder 1 is caused to retract to perform a boom-lowering operation. During the above-described switching operation, the directional control valve 7 for the boom is adjusted in the amount of opening in accordance with the manipulation stroke of the control means so that the extension/retraction speed of the boom cylinder 1 is controlled.

When a hydraulic pilot pressure which has been adjusted in pressure is outputted to the left signal-receiving port of the directional control valve 8 for the arm via an unillustrated pilot line, on the other hand, the directional control valve 8 for the arm is switched from the neutral position to the left position (the position illustrated in FIG. 1). The directional control valve 8 for the arm then feeds pressure oil from the main hydraulic pump 4 to the bottom chamber 2*a* of the arm cylinder 2 via the bottom-side line 8*a*, and also releases pressure oil from its rod chamber 2*b* to the working oil reservoir 6 via the rod-side line 8*b*, the restrictor 8*c* within the directional control valve 8 for the arm and the reservoir line 8*c*. As a consequence, the arm cylinder 2 is caused to extend to perform a arm-crowding operation.

Similarly, the directional control valve 8 for the arm is switched to the right position when a hydraulic pilot pressure is outputted to the right signal-receiving port via an unillustrated pilot line. The directional control valve 8 for the arm then feeds pressure oil from the main hydraulic pump 4 to the rod chamber 2*b* of the arm cylinder 2 via the rod-side line 8*b*, and also releases pressure oil from its bottom chamber 2*a* to the working oil reservoir 6 via the bottom-side line 8*a* and reservoir line 8*c*. As a consequence, the arm cylinder 2 is caused to retract to perform an arm-dumping operation. During the above-described switching operation, the directional control valve 8 for the arm is adjusted in the amount of opening in accordance with the manipulation stroke of the control means so that the extension/retraction speed of the arm cylinder 2 is controlled.

Also shown are a communication line 10 arranged branching out from the rod-side line 8*b* of the directional control valve 8 for the arm to feed pressure oil from the rod chamber 2*b* of the arm cylinder 2 to the bottom-side line 7*a* via the directional control valve 7 for the boom, a subline 10*a* as a pilot line for guiding pilot oil for the below-described poppet valve 14 for the communication line to a secondary communication line 10 of the poppet valve 14, a pilot line 11 arranged branching out from the communication line 10 to feed, as a hydraulic pilot pressure, pressure oil from the rod chamber 2*b* of the arm cylinder 2, a combined flow-rate control valve for the boom (logic valve) 12 as an opening means composed of the below-described selector valve 13 and the poppet valve 14 for the communication line and capable of selectively opening the communication line 10, the spring-offset, pilot-operated, two-port two-position selector valve 13 arranged in the subline 10*a* and normally switched to the right position to dose the subline 10*a*, and the poppet valve 14 for the communication line to close the communication line 10 during the closure of the subline 10*a* by the selector valve 13 or to open the communication line 10 during the opening of the subline 10*a* by the selector valve 13.

Although the selector valve 13 is equivalent to a normally-closed on/off valve capable of controlling a flow rate, it is switched to the left position to open the subline 10*a* when a hydraulic pilot pressure set to the below-described predetermined pressure value or higher is fed to its signal-receiving port via the pilot line 11. As a consequence, the pilot oil inside the poppet valve 14 for the communication line is released to the communication line 10 via the subline 10*a*. In this case, the selector valve 13 is adjusted in the amount of opening in accordance with the level of the hydraulic pilot pressure fed to its signal-receiving portion from the pilot line 11. As a consequence, the flow rate of pilot oil passing through the selector valve 13 is adjusted. By adjusting the flow rate of the pilot oil, the selector valve 13 can control the amount of opening of the below-described poppet valve 14 for the communication line.

The poppet valve 14 for the communication line is provided with a valve element 14*a* movable in an up-and-down direction. When the valve element 14*a* is at an upper position, the poppet valve 14 closes the communication line 10. When the valve element 14*a* moves downwards from the upper position, the poppet valve 14 opens the communication line 10 so that pressure oil is fed from the rod chamber 2*b* of the arm cylinder 2 to the directional control valve 7 for the boom via the communication line 10. In this case, the amount of opening is adjusted corresponding to the distance of the downward movement of the valve element 14*a*, and as a consequence, the flow rate of pressure oil passing through the poppet valve 14 is adjusted. The pilot pressure inside this poppet valve 14 is allowed to flow out to the outside as a result of the opening of the selector valve 13, the valve element 14*a* moves downwards form the upper position. Otherwise, the valve element 14*a* is set at the upper position to close the communication line 10. In this case, the amount of the downward movement of the valve element 14*a* is adjusted depending on the flow rate of the pilot oil that is flowing out, in other words, the amount of opening of the selector valve 13. Consequently, the flow of pressure oil through the communication line 10 can be controlled by the hydraulic pilot pressure in the pilot line 11. In this specification, the combined unit of the selector valve 13 and poppet valve 14 for the communication line, said combined unit being adapted to perform such control, is positioned as the combined flow-rate control valve 12 for the boom.

When grading work is performed by a combined operation of boom raising and arm crowding, the directional control valve 7 for the boom and the directional control valve 8 for the arm are switched to the left positions as illustrated in FIG. 1. As a result, pressure oil is fed from the main hydraulic pump 4 to the bottom chamber 1*a* of the boom cylinder 1 and the bottom chamber 2*a* of the arm cylinder 2, and pressure oils are released from the rod chamber 1*b* of the boom cylinder 1 and the rod chamber 2*b* of the arm cylinder 2. At this time, the pressure oil in the rod chamber 2*b* of the arm cylinder 2 becomes about to dram from the rod-side line 8*b* to the reservoir line 8*c* via the directional control valve 8 for the arm. The release-side flow passage inside the directional control valve 8 for the arm is restricted by the restrictor 8*d* to confine a pressure within the rod chamber 2*b* of the arm cylinder 2. Accordingly, the arm 32 is prevented from falling by its own weight to permit performing grading work that horizontally moves the bucket 33 by the arm 32.

As a result, the pressure inside the rod chamber 2*b* of the arm cylinder 2 is caused to rise by a hydraulic pressure applied to a piston 2*c* from the side of the bottom chamber 2*a* of the arm cylinder 2 and the own weight of the arm 32 also applied to the piston 2*c*. Consequently, the hydraulic pressure inside the rod-side line 8*b* also rises. The pressures of the pressure oils, which are fed to the bottom chamber 1*a* of the boom cylinder 1 and the bottom chamber 2*a* of the arm cylinder 2 via the first pressure oil feed line 4*a* and second pressure oil feed line 4*b* connected in parallel with each other, are equal to each other. Further, the hydraulic pressure in the rod chamber 2*b* of the arm cylinder 2 is higher than the hydraulic pressure in its bottom chamber 2*a*, because the pressure-receiving area of the piston 2*c* of the arm cylinder 2 is smaller on the side of the rod chamber 2*b* than on the bottom chamber 2*a*.

For the reasons mentioned above, the pressure in the rod chamber 2*b* of the arm cylinder 2 can be made higher than the pressure in the bottom chamber 1*a* of the boom cylinder 1 in grading work if the pressure in the rod chamber 2*b* of the arm cylinder 2 is prevented from draining to the working oil reservoir 6. The pressure oil in the rod chamber 2*b* of the arm cylinder 2 can, therefore, be utilized for the acceleration of the boom cylinder 1 provided that, in a state that the reservoir line 8*c* is closed upon performing grading work, the pressure oil in the rod chamber 2*b* of the arm cylinder 2 is combined to the pressure oil from the main hydraulic pump 4 via the communication line 10 and the directional control valve 7 for the boom and the thus-combined pressure oil is fed to the bottom chamber 1*a* of the boom cylinder 1 via the bottom-side line 7*a*.

The pilot line 11 is a line that guides the pressure oil in the rod chamber 2*b* of the arm cylinder 2 as a hydraulic pilot pressure to the signal-receiving port of the selector valve 13 and that of the below-described selector valve 16, and the selector valve 13 is switched to its left position when the pressure of pressure oil in its rod chamber 2*b* has arisen to a high pressure of the predetermined pressure value set beforehand or higher. The selector valve 13 then opens the subline 10*a* and drains a portion of the pilot oil in the poppet valve 14 for the communication line to the communication line 10 on the downstream side of the poppet valve 14. As a consequence, the poppet valve 14 opens the communication line 10 so that the hydraulic pressure in the rod chamber 2*b* of the arm cylinder 2 is fed to the directional control valve 7 for the boom via the communication line 10 and is combined to the pressure oil in the bottom-side line 7*a*.

The present value for the hydraulic pilot pressure in the pilot line 11 for switching the selector valve 13 and the below-described selector valve 16 to the right positions upon performing grading work is basically a signal pressure for detecting that grading work is being performed. The preset value can, therefore, be a preset value for the rod-side pressure of the arm cylinder 2, which can detect the performance of grading work and can be selectively determined by a person skilled in the art as desired upon designing, for example, can be set at a value of a rod-side pressure of the arm cylinder 2 as expected in grading work or can be set at a value large enough to distinguish it from a pressure value on the rod side of the arm cylinder 2 in earth/sand digging work.

There are also shown a subline 8' as a pilot line for guiding pilot oil from the below-described poppet valve 17 for the reservoir line to a secondary reservoir line 8*c* of the poppet valve 17, a meter-out flow-rate control valve (logic valve) 15 for the arm, said control valve 15 being composed of the below-described selector valve 16 and the poppet valve 17 for the reservoir line and being arranged as a closure means capable of selectively dosing the reservoir line 8*c*, a spring-offset, pilot-operated, two-port two-position selector valve 16 arranged in the subline 8' and normally switched to the right position to open the subline 8', and the poppet valve 17 for the reservoir line to open the reservoir line 8*c* during the opening of the subline 8*c'* by the selector valve 16 or to close the reservoir line 8*c* during the closure of the subline 8' by the selector valve 16.

The selective valve 16 and the poppet valve 17 for the reservoir line are not fundamentally different in structure from the above-described selector valve 13 and poppet valve 14 for the communication line, but the selector valve 16 is different from the selector valve 13 only in that the former serves as a normally-open on/off valve capable of performing flow-rate control while the latter serves as a normally-closed on/off valve. The hydraulic pressure of the rod chamber 2*b* of the arm cylinder 2, as a hydraulic pilot pressure, is also guided to the signal-receiving port of the selector valve 16 via the pilot line 11 and, when this hydraulic pressure has arisen to a high pressure of the predetermined pressure value set beforehand or higher, switches the selector valve 16 to the left position. Conversely to the selector valve 13, the selector valve 16 then closes the subline 8'. As a consequence, the poppet valve 17 closes the reservoir line 8*c* in contrast to the poppet valve 14 to prevent the hydraulic pressure from draining from the rod chamber of the arm cylinder 2 to the working oil reservoir 6. As a result, it is possible to surely increase the pressure in the rod chamber 2*b* of the arm cylinder 2.

A description will next be described about advantageous effects available when grading work is performed by a combined operation of boom raising and arm crowing with the hydraulic drive system provided with the above-described means for the hydraulic excavator.

Now, assuming that grading work is performed by feeding pressure oil to the bottom chamber 1*a* of the boom cylinder 1 and the bottom chamber 2*a* of the arm cylinder 2 and operating both the cylinders 1,2 in combination, a hydraulic pressure is then confined within the rod chamber 2*b* of the arm cylinder 2 owing to the restriction of the release-side flow passage inside the directional control valve 8 for the arm by the restrictor 8*d*, and eventually, the hydraulic pressure in the rod chamber 2*b* of the arm cylinder 2 rises to a high pressure of the predetermined pressure value or higher. As a consequence, it is possible to detect that the grading work is being performed. In this state, the hydraulic pressure is outputted as a control signal for a hydraulic pilot pressure from the rod chamber 2*b* to the combined flow-rate control valve 12 for the boom and the meter-out flow-rate control valve 15 for the arm via the pilot line 11, so that both the flow-rate control valves 12,15 are actuated to open the communication line 10 and to close the reservoir line 8*c*.

Owing to the closure of the reservoir line 8*c* as described above, the pressure of the pressure oil in the rod chamber 2*b* of the arm cylinder 2 can be caused to rise further, without allowing it to drain to the working oil reservoir 6, to such a level as making it possible to increase the oil pressure in the bottom chamber 1*a* of the boom cylinder 1. Owing to the opening of the communication line 10, on the other hand, the pressure oil of this high pressure in the rod chamber 2*b* is fed to the bottom chamber 1*a* of the boom cylinder via the communication line 10, the directional control valve 7 for the boom cylinder and the bottom-side line 7*a*. This pressure oil is combined to the pressure oil to be fed from the main hydraulic pump 4 to the bottom chamber 1*a* of the boom cylinder 1, so that the boom cylinder 1 can be caused to extend faster than before. As is appreciated from the foregoing, the hydraulic drive system for the hydraulic excavator makes it possible to efficiently perform grading work by utilizing the pressure of the pressure oil on the rod side of the arm cylinder 2, said pressure being the residual energy of the pressure oil in the hydraulic circuit, although no attention was paid to such residual energy in the conventional technology.

A description will next be described about advantageous effects available when earth/sand digging work is performed by a combined operation of boom raising and arm crowing with the hydraulic drive system for the hydraulic excavator.

Now, assuming that earth/sand digging is performed by feeding pressure oil to the bottom chamber 1*a* of the boom cylinder 1 and the bottom chamber 2*a* of the arm cylinder 2 and operating both the cylinders 1,2 in combination, a hydraulic pressure is then confined within the rod chamber 2*b* of the arm cylinder 2 owing to the restriction of the release-side flow passage inside the directional control valve 8 for the arm by the restrictor 8*d* as in the performance of the grading work. When earth/sand digging work is performed by crowding the arm 32, however, the bucket 33 is driven into the earth, and as a result, excavation reaction force acts on the arm 32 by way of the bucket 33 as if the arm 32 is lifted upwards. This excavation reaction force to the arm 32 then applies, to the piston 2*c*, force that tends to expand the rod chamber 2*b* of the arm cylinder 2. The hydraulic pressure in the rod chamber 2*b* of the arm cylinder 2, therefore, does not rise in such a way as it does during performance of grading work.

Accordingly, the pressure of the pressure oil in the rod chamber 2*b* of the arm cylinder 2 does not rise to the predetermined pressure value set beforehand, and can actuate neither the combined flow-rate control valve 12 for the boom nor the mater-out flow-rate control valve 15 for the arm. Conversely to the time that grading work is being performed, the communication line 10 and reservoir line 8*c* are in a closed state and open state, respectively. Therefore, pressure oil is fed only from the main hydraulic pump 4 to the bottom chamber 1*a* of the boom cylinder 1 via the bottom-side line 7*a*, and the pressure oil in the rod chamber 1*b* of the boom cylinder 1 is released from the rod-side line 7*b* via the reservoir line 7*c*, so that a boom-raising operation is performed as usual. To the bottom chamber 2*a* of the arm cylinder 2, pressure oil is fed from the main hydraulic pump 4 via the bottom-side line 8*a*, and the pressure oil in the rod chamber 2*b* of the arm cylinder 2 is released via the directional control valve 8 for the arm and the reservoir line 8*c* without flowing from the rod-side line 8*b* to the communication line 10, so that an arm crowding operation is performed as usual.

As has been described above, the hydraulic drive system for the hydraulic excavator makes it possible to automatically detect, based on a hydraulic pilot pressure in the pilot line 11, whether grading work or earth/sand digging work is performed during a combined operation of boom raising and arm crowding. When the performance of grading work is detected, the grading work can be efficiently performed by utilizing the residual energy of the pressure oil on the rod side of the arm cylinder 2 although the residual energy has heretofore been unutilized, thereby making it possible to contribute to improvements in the energy saving of hydraulic drive systems. Further, the means specifically added to the hydraulic drive system for the promotion of efficiency with respect to grading work give no problem at all to a hydraulic drive operation for earth/sand digging work. When the performance of earth/sand digging work is detected, a combined operation of boom raising and arm crowding for the digging of earth or sand can, therefore, be smoothly performed by a drive operation not different from usual without adding any special means for earth/sand digging work.

Legend

Figure 1:
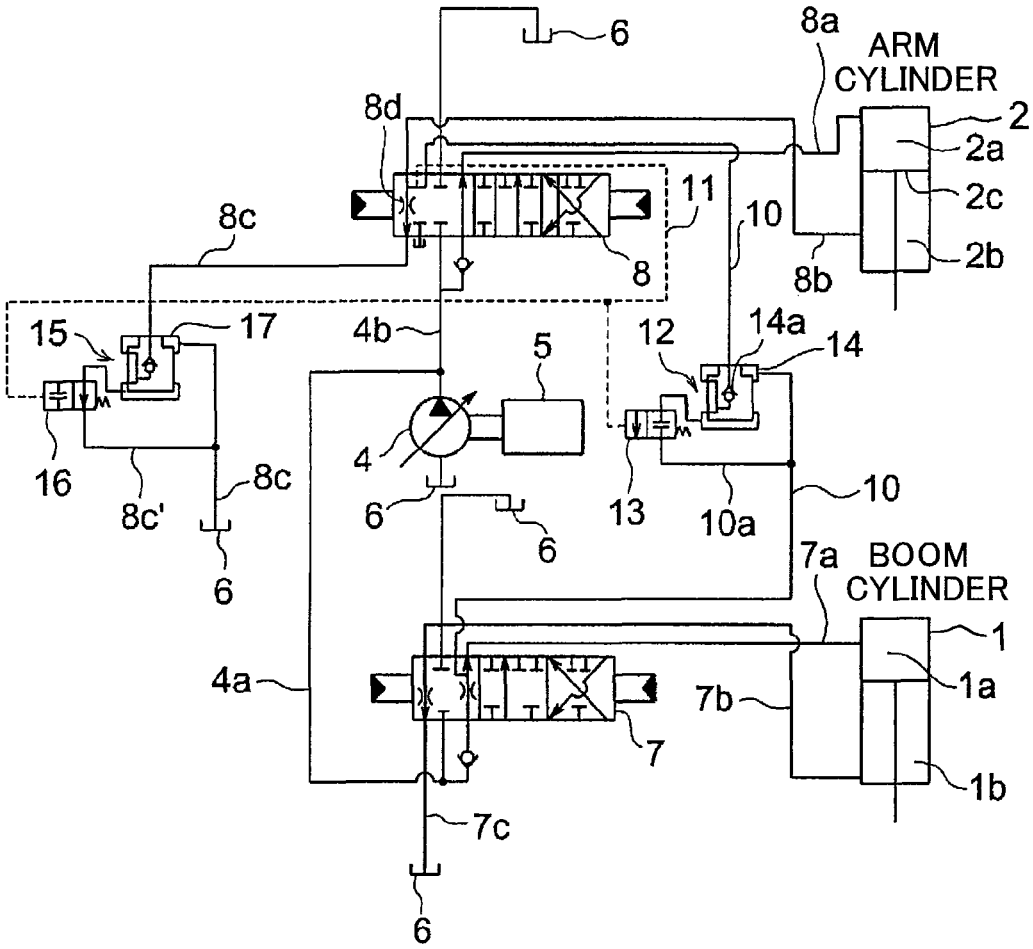
FIG. 1 A hydraulic circuit diagram of a hydraulic drive system for a hydraulic excavator, said hydraulic drive system having been constructed by embodying the present invention.
Figure 2:
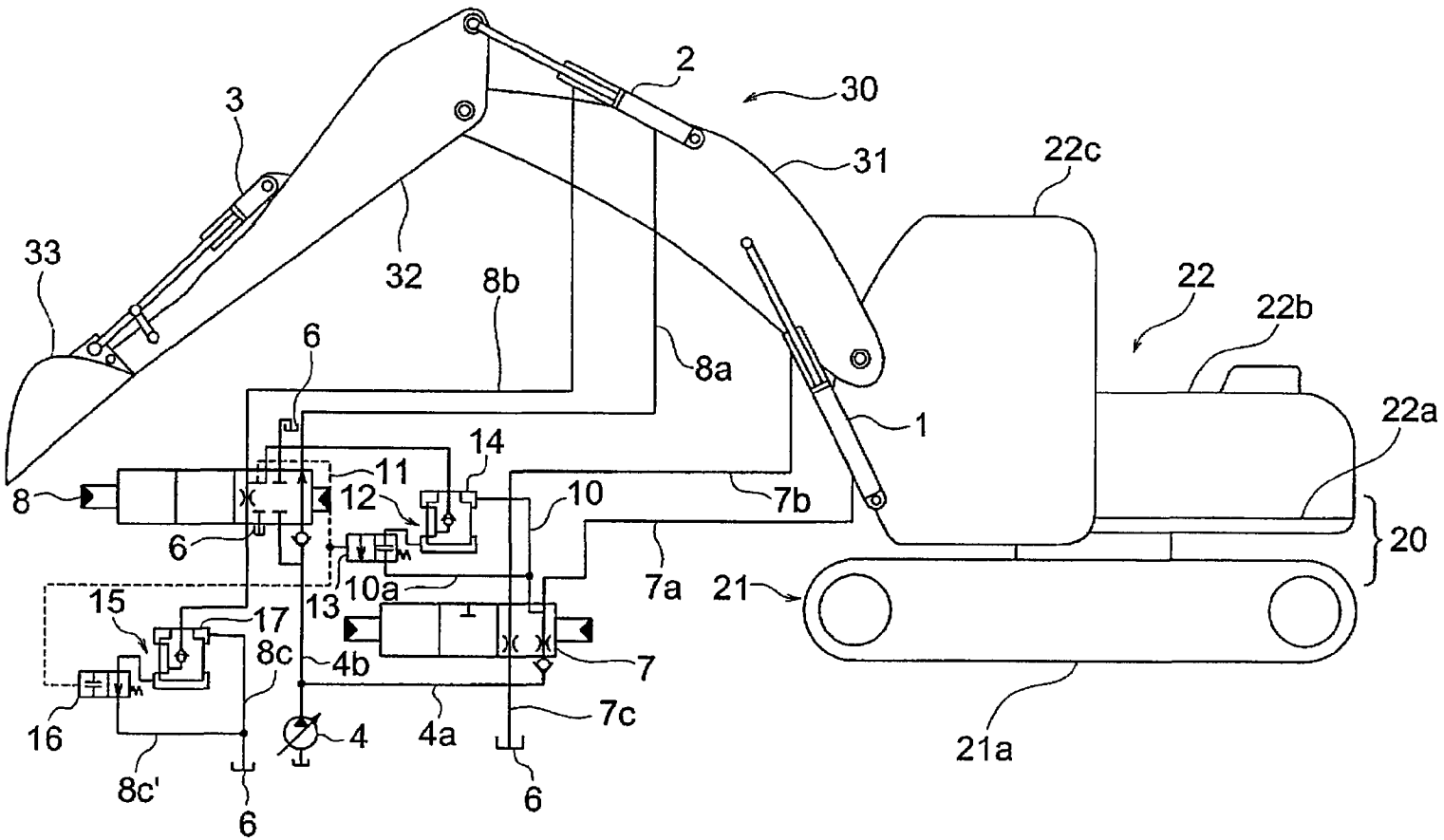
FIG. 2 A side view of the hydraulic excavator provided with the hydraulic drive system of FIG. 1.

1 Boom cylinder
1*a* Bottom chamber (of the boom cylinder 1)
1*b* Rod chamber (of the boom cylinder 1)
2 Arm cylinder
2*a* Bottom chamber (of the arm cylinder 2)
2*b* Rod chamber (of the arm cylinder 2)
2*c* Piston (of the arm cylinder 2)
3 Bucket cylinder
4 Main hydraulic pump
4*a*,4*b* Pressure-oil feed lines
5 Engine
6 Working oil reservoir
7 Directional control valve for the boom
7*a* Bottom-side line (for the directional control valve 7 for the boom)
7*b* Rod-side line (for the directional control valve 7 for the boom)
7*c* Reservoir line (for the directional control valve 7 for the boom)
8 Directional control valve for the arm
8*a* Bottom-side line (for the directional control valve 8 for the arm)
8*b* Rod-side line (for the directional control valve 8 for the arm)
8*c* Reservoir line (for the directional control valve 8 for the arm)
8*c*' Subline
8*d* Restrictor (in the directional control valve 8 for the arm)
10 Communication line
10*a* Subline
11 Pilot line
12 Combined flow-rate control valve (logic valve) for the boom
13 Selector valve
14 Poppet valve for the communication line
15 Meter-out flow-rate control valve (logic valve) for the arm
16 Selector valve
17 Poppet valve for the reservoir line
20 Body
21 Undercarriage
22 Revolving upperstructure
30 Front working implement
31 Boom
32 Arm
33 Bucket

What is claimed is:

1. A hydraulic drive system for a hydraulic excavator that performs digging work and grading work by a combined operation of boom raising and arm crowding, said system comprising:

a boom cylinder and arm cylinder for driving a boom and arm of a front working implement, respectively, a main hydraulic pump as a generation source of a hydraulic pressure to be fed to said boom cylinder and arm cylinder, a directional control valve for said boom to control a flow of pressure oil to be fed from said main hydraulic pump to a bottom chamber or a rod chamber of said boom cylinder and to control an extending or retracting direction of said boom cylinder and a speed thereof, a directional control valve for said arm to control a flow of pressure oil to be fed from said main hydraulic pump to a bottom chamber or a rod chamber of said arm cylinder, and to control an extending or retracting direction of said arm cylinder and a speed thereof, a reservoir line connecting said directional control valve for said arm cylinder with a working oil reservoir, a communication oil passage that connects the rod chamber of said arm cylinder with the bottom chamber of said boom cylinder via said directional control valve for said arm cylinder and said directional control valve for said boom cylinder, a restrictor that is arranged in a release-side oil passage on a switching position of said directional control valve for said arm cylinder which drives said arm cylinder in the extending direction, a pilot oil passage that guides pressure oil in the rod chamber of said arm cylinder as a hydraulic pilot pressure, a combined flow-rate control valve for said boom which is arranged on said communication oil passage to control opening and closing of said communication oil passage by a pressure value in said pilot oil passage, and a meter-out flow-rate control valve for said arm which is arranged on said reservoir line to control opening and closing of said reservoir line by a pressure value in said pilot oil passage, wherein upon performing the combined operation of boom raising and arm crowding, when a pressure in the rod chamber of said arm cylinder has decreased to a predetermined pressure value indicative of digging work being performed, said reservoir line that connects the rod chamber of said arm cylinder with the working oil reservoir is opened by switching said meter-out flow-rate control valve for said arm to an opening position by the hydraulic pilot pressure and said communication oil passage is closed by switching said combined flow-rate control valve for said boom to a closing position by the hydraulic pilot pressure, and when a pressure in the rod chamber of said arm cylinder has increased to a predetermined pressure value indicative of grading work being performed, said reservoir line that connects the rod chamber of said arm cylinder with the working oil reservoir is closed by switching said meter-out flow-rate control valve for said arm to a closing position by the hydraulic pilot pressure and said communication oil passage is opened by switching said combined flow-rate control valve for said boom to an opening position by the hydraulic pilot pressure so that the pressure oil in the rob chamber of said arm cylinder is fed to the bottom chamber of said boom cylinder.

* * * * *